United States Patent [19]

Caffarella et al.

[11] 4,213,052

[45] Jul. 15, 1980

[54] MINIATURE RADIOACTIVE LIGHT SOURCE AND METHOD OF ITS MANUFACTURE

[75] Inventors: Thomas E. Caffarella; George J. Radda; Harry H. Dooley, Jr., all of Tucson, Ariz.

[73] Assignee: American Atomics Corporation, Tucson, Ariz.

[21] Appl. No.: 916,876

[22] Filed: Jun. 19, 1978

[51] Int. Cl.[2] ..... F21K 2/00

[52] U.S. Cl. ..... 250/462; 250/463; 250/493

[58] Field of Search ..... 250/463, 462, 493; 65/105, 56; 219/121 L, 121 LM

[56] References Cited

U.S. PATENT DOCUMENTS

| | | | |
|---|---|---|---|
| 1,330,180 | 2/1920 | Erdle | 250/463 |
| 2,300,917 | 11/1942 | Gaskill | 65/105 |
| 3,368,287 | 2/1968 | Ault | 250/463 |
| 3,409,770 | 11/1968 | Clapham | 250/462 |
| 3,478,209 | 11/1969 | Feuer | 250/462 |
| 3,706,543 | 12/1972 | Thuler | 65/105 |
| 3,817,733 | 6/1974 | Thuler | 65/56 |
| 4,044,936 | 8/1977 | Obersby | 219/121 L |

*Primary Examiner*—Harold A. Dixon

*Attorney, Agent, or Firm*—Christie, Parker & Hale

[57] ABSTRACT

A glass tube, laser sealed at its ends, has an elongated cross section, two wide side faces, and two narrow side faces. The tube contains a radioactive gas and a transducer, such as a phosphor compound, responsive to the gas. The narrow side faces of the tube are thicker than the wide side faces. Preferably, the wide side faces are outwardly bowed and the narrow side faces are semicylindrical to form an oval cross section. The ratio of the total glass thickness of the wide side faces to the spacing between the wide side faces is approximately 0.7.

12 Claims, 4 Drawing Figures

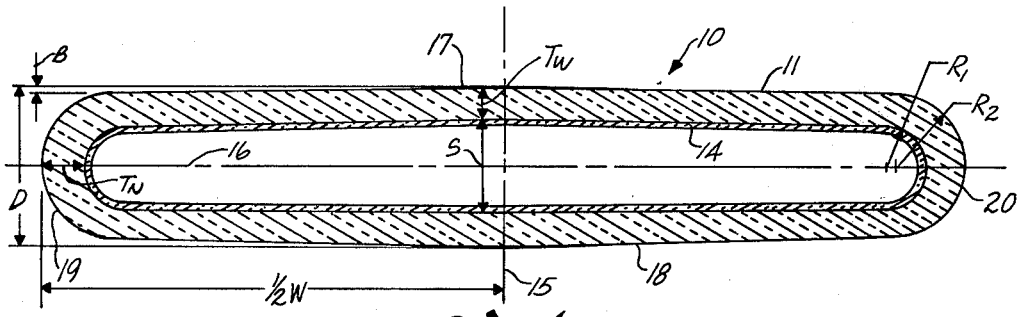
Fig. 1
Fig. 2
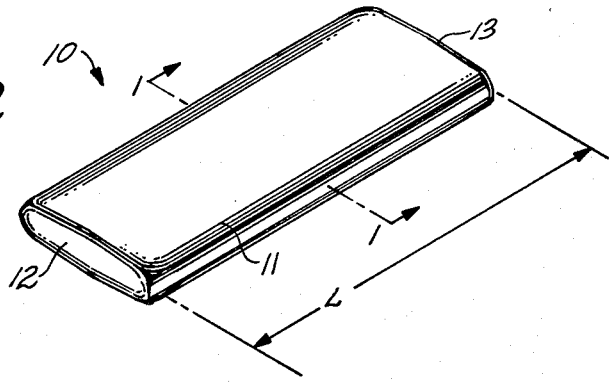
Fig. 4
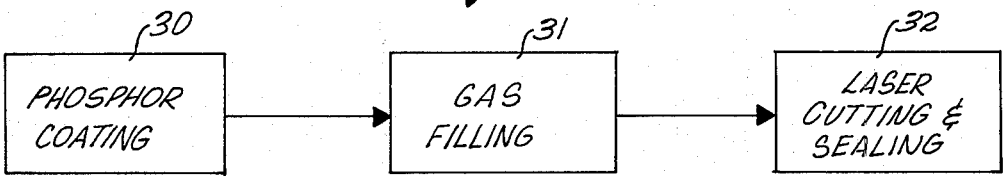

MINIATURE RADIOACTIVE LIGHT SOURCE AND METHOD OF ITS MANUFACTURE

BACKGROUND OF THE INVENTION

This invention relates to the conversion of radiation to other useful forms of energy and, more particularly, to a miniature radioactive light source and a method of its manufacture.

Miniature radioactive light sources are currently employed to backlight liquid crystal displays in digital watches and other instruments with visual displays. In contrast to incandescent lamps, a radioactive light source requires no electrical power source, and provides many years of maintenance free operation. Such a radioactive light source comprises a glass tube sealed at its ends, phosphor coated on its inner surface, and filled with tritium gas. When beta emission from the tritium strikes the phosphor coating, visible light is emitted.

The glass tube may have a circular or elongated cross section. An elongated cross section has the advantage that a larger area of a liquid crystal display can be illuminated by a single light source without increasing the thickness of the liquid crystal display-light source assembly. Further, a wide light source having an elongated cross section, makes more efficient use of the tritium gas.

The described miniature radioactive light sources are manufactured in the following way: the inner surface of a long glass tube is coated with a phosphor compound; the long, phosphor coated tube is filled with tritium and sealed at its ends with a gas flame; the long, tritium filled tube is subdivided into shorter tube segments by means of a laser beam to produce the light sources; and the resulting light sources are tested for radiation leakage.

Government licensing regulations place stringent requirements on the external radiation level of such radioactive light sources. If the light sources do not pass the leakage test, they must be rejected. Thus, reliable laser sealed ends on the glass tube are essential to good quality control in mass production.

SUMMARY OF THE INVENTION

The invention attains improved strength in wide miniature radioactive light sources, without increasing depth, and reliable laser seals at the ends of the glass tube, which is the envelope for such light source.

According to one aspect of the invention, the narrow side faces of the tube are thicker than the wide side faces thereof. This permits the production of wider radioactive light sources capable of withstanding the tritium fill pressure without increasing the depth of the radioactive light source. Preferably, the wide side faces of the glass tube are outwardly bowed and the narrow side faces thereof are semi-cylindrical to form an oval cross section.

According to another aspect of the invention, the ratio of the total glass thickness of the wide side faces of the tube to the spacing between the wide side faces thereof is approximately 0.7. It has been found that this ratio provides the most reliable laser seals at the ends of the tube in mass production.

For a radioactive light source having a specified depth and brightness, the thickness of the wide side faces is designed to meet the 0.7 ratio specified above, and the thickness of the narrow side faces is selected to withstand the necessary tritium fill pressure. The result is a wide, structurally sound radioactive light source having shallow depth and reliable laser end seals.

BRIEF DESCRIPTION OF THE DRAWINGS

The features of a specific embodiment of the best mode contemplated of carrying out the invention are illustrated in the drawings, in which FIG. 1 is a cross sectional view of a radioactive light source incorporating the principles of the invention;

FIG. 2 is a perspective view of the light source of FIG. 1;

FIG. 4 is a block diagram of the method of manufacturing the light source of FIGS. 1 and 2.

DETAILED DESCRIPTION OF THE SPECIFIC EMBODIMENT

Figure 3:
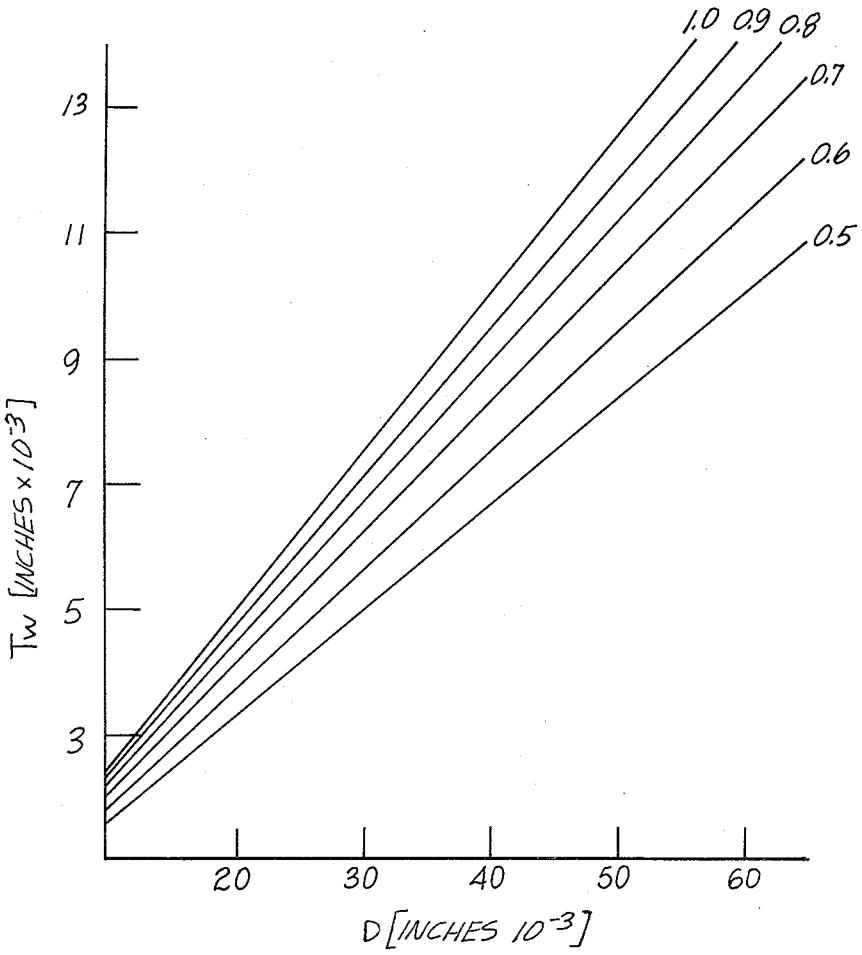
FIG. 3 is a graph of different ratios of the total glass thickness of the wide side faces to the spacing between the wide side faces of a radioactive light source.

In FIGS. 1 and 2, a radioactive light source 10 is shown. Light source 10 comprises a glass tube 11 that has an elongated cross section, as shown in FIG. 1, and laser sealed ends 12 and 13, as shown in FIG. 2. The inside surface of tube 11 has a phosphor coating 14. Tube 11 contains tritium gas, usually at superatmospheric pressure. Beta radiation from the tritium gas in tube 11 strikes coating 14 to emit visible light used to illuminate a liquid crystal display or other object. Tube 11 serves as an envelope to confine the tritium and as a substrate for the phosphor coating.

As shown in FIG. 1, tube 11, which is symmetrical about a vertical center axis 15 and a horizontal center axis 16, has oppositely disposed wide side faces 17 and 18, and oppositely disposed narrow side faces 19 and 20. Wide side faces 17 and 18 each have a uniform thickness designated $T_W$. Narrow side faces 19 and 20 each have a thickness that gradually increases from $T_W$ to a maximum thickness designated $T_N$ along center axis 16. The width of light source 10 is designated W in FIG. 1. The length of light source 10 is designated L in FIG. 2. Wide side faces 17 and 18 are outwardly bowed, and narrow side faces 19 and 20 are semicylindrical to form an oval cross section. Narrow side faces 19 and 20 have an outside radius designated $R_2$ and an inside radius designated $R_1$, whose centers are eccentrically positioned to gradually increase the thickness of narrow side faces 19 and 20 from $T_W$ to $T_N$. The extent of bowing of wide side faces 17 and 18 is designated B. The spacing between wide side faces 17 and 18 is designated S. The maximum depth of tube 11, designated D, is equal to $S+2T_W$. To provide the structural strength to withstand the tritium fill pressure exerted on tube 11, narrow side faces 19 and 20 are thicker than wide side faces 17 and 18, i.e., $T_N$ is larger than $T_W$. Bowing wide side faces 17 and 18 further strengthens tube 11 by putting the center of wide side faces 17 and 18 in tension, and transferring the force of the pressurized tritium exerted thereon to the edges of wide side faces 17 and 18. This concentrates the bending forces and moments at the thickest portion of the wall of tube 11, which can structurally best withstand their effects.

FIG. 3 is a graph of the relationship between the ratio of total glass thickness to spacing between wide side faces 17 and 18, the thickness $T_W$ of wide side faces 17 and 18 in thousandths of an inch, and the maximum depth D of tube 11 in thousandths of an inch. The lines in FIG. 3 represent ratios of the total glass thickness of wide side faces 17 and 18, i.e., $2T_W$, to the spacing between wide side faces 17 and 18, i.e., $D-2T_W$, ranging from 0.5 to 1.0. It has been found that a ratio of the total glass thickness of the wide side faces to spacing between the wide side faces of approximately 0.7 provides the most reliable laser end seals 12 and 13 for tube 11. If the ratio is smaller than 0.7, there tends to be insufficient glass to cover the hollow at the end of the tube. If the ratio is larger than 0.7, there tends to be too much glass to melt and fuse completely.

In designing a radioactive light source of the described type, the depth D, width W, and brightness of the source are specified. The brightness of the source depends upon the tritium fill pressure and the spacing S between the wide side faces. From the graph of FIG. 3, the wide side face thickness $T_W$ is selected for the specified depth D from the line representing the desired ratio 0.7. From this the spacing S between the wide side faces can be calculated, specifically, $S=D-2T_W$. Accordingly, the fill pressure necessary to achieve the specified brightness for the calculated spacing S is then determined. Finally, the thickness $T_N$ of the narrow side faces is selected to be sufficiently large for the specified width W to withstand the fill pressure necessary to achieve the specified brightness.

In one embodiment of a radioactive light source incorporating the principles of the invention, W is 0.200 (±0.003) inches, D is 0.034 (±0.002) inches, L is 0.750 inches, S is 0.020 inches, $T_W$ is 0.007 (±0.001) inches, $T_N$ is 0.009 (±0.001) inches, $R_1$ is 0.008 inches with a center on axis 16 spaced 0.083 inches from axis 15, $R_2$ is 0.015 inches with a center on axis 16 spaced 0.085 inches from axis 15, B is 0.002 inches, the tritium fill pressure is 3 psig at room temperature, and tube 11 is borasilicate glass. The dimensions in parentheses are tolerances.

Reference is made to FIG. 4 for a description of the method of manufacturing radioactive light sources according to the invention. As represented by a block 30, a phosphor coating is deposited on the inside surface of a long glass tube having the desired cross-sectional shape and dimensions, e.g., those shown in FIG. 1. This long glass tube is typically a foot or longer in length. As represented by a block 31, the phosphor coated tube is filled with tritium gas, preferably while at cryogenic temperature. One end of the tube is first sealed by heating the glass to fusion with a gas flame, the tube is evacuted, the tube is then filled with the tritium gas, and the other end of the tube is then sealed by heating the glass to fusion with a gas flame. As represented by a block 32, the long, phosphor coated, tritium filled sealed tube is subdivided into short tube segments of the desired length (e.g., 0.750 inches) for the radioactive light sources by a laser. The laser beam cuts and seals the ends of the tube segments in a single operation, thereby producing tube segments that are laser sealed at their ends. Preferably, the method described in application Ser. No. 811,489, filed June 30, 1977, by Thomas E. Caffarella, George J. Radda, and David J. Watts, entitled METHOD AND APPARATUS FOR SUBDIVIDING A GAS FILLED GLASS TUBE, which is assigned to the assignee of the present application, is used to carry out the operation of subdividing the long glass tube into tube segments.The disclosure of application Ser. No. 811,489 is incorporated herein fully by reference. However, it is believed that the invention is also applicable to radioactive light sources that are laser sealed by other methods such as the method described in Thuler U.S. Pat. Nos. 3,706,543 and 3,817,733.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention as set forth in the following claims. For example, instead of a phosphor coating on the inside of the glass tube, radiation responsive voltage generating cells or other types or radiation responsive transducers could be placed in a laser sealed radioactive gas filled glass tube incorporating the principles of the invention. Further, although it is preferable to employ conjointly the feature of thicker narrow side faces than wide side faces and the feature of a 0.7 thickness to spacing ratio for the wide side faces, either of these features could be employed without the other to attain the advantages described for such feature. Although an oval cross section formed by outwardly bowed wide side faces and semicylindrical narrow side faces has been found preferable, the principles of the invention are applicable to light sources having a rectangular cross section as well. Moreover, the principles of the invention apply to light sources using a radioactive gas other than tritium.

What is claimed is:

1. A miniature radioactive light source comprising:

a glass tube laser sealed at its ends, the glass tube having an elongated cross section, two wide side faces, and two narrow side faces;

a radioactive gas contained in the tube; and an energy transducer in the tube responsive to the gas, the improvement characterized in that the narrow side faces are thicker than the wide side faces and the ratio of the total glass thickness of the wide side faces to the spacing between the wide side faces is approximately 0.7.

2. The light source of claim 1, in which the elongated cross section is oval.

3. The light source of claim 1, in which the wide side faces are outwardly bowed parallel to the elongated cross section.

4. The light source of claim 3, in which the narrow side faces are semicylindrical.

5. The light source of claim 4, in which the inside surface and the outside surface of the narrow side faces have different radii and different centers selected to gradually increase the thickness of each narrow side face from the edges to the center thereof.

6. The light source of claim 5, in which the ratio of the total glass thickness of the wide side faces to the spacing between the wide side faces is approximately 0.7.

7. The light source of claim 6, in which the wide side faces each have a uniform thickness.

8. The light source of claim 1, in which the narrow side faces are semicylindrical.

9. The light source of claim 8, in which the inside surface and the outside surface of the narrow side faces have different radii and different centers selected to gradually increase the thickness of each narrow side face from the edges to the center thereof.

10. The light source of claim 1, in which the radioactive gas is tritium.

11. The light source of claim 1, in which the transducer is a phosphor coating on the inside surface of the glass tube, the phosphor coating emitting visible light responsive to radiation from the gas.

12. The light source of claim 1, in which the wide side faces each have a uniform thickness.

* * * * *